US009930984B1

(12) United States Patent
Holmes

(10) Patent No.: US 9,930,984 B1
(45) Date of Patent: Apr. 3, 2018

(54) GARMENT HANGER

(71) Applicant: John Anthony Holmes, Waverly, AL (US)

(72) Inventor: John Anthony Holmes, Waverly, AL (US)

( * ) Notice: Subject to any disclaimer, the term of this patent is extended or adjusted under 35 U.S.C. 154(b) by 32 days.

(21) Appl. No.: 15/065,818

(22) Filed: Mar. 9, 2016

Related U.S. Application Data

(60) Provisional application No. 62/130,417, filed on Mar. 9, 2015.

(51) Int. Cl.
*A47G 25/28* (2006.01)
*A47G 25/36* (2006.01)
*A47G 25/14* (2006.01)

(52) U.S. Cl.
CPC ..... *A47G 25/28* (2013.01); *A47G 25/36* (2013.01); *A47G 2025/1485* (2013.01)

(58) Field of Classification Search
CPC ..... A47G 25/00–25/62; A47G 2025/1485
USPC ..... D6/315, 318
See application file for complete search history.

(56) References Cited

U.S. PATENT DOCUMENTS

| | | | | | |
|---|---|---|---|---|---|
| D64,774 | S | | 5/1924 | Eyk | |
| 1,641,680 | A | | 9/1927 | Kaufman | |
| 1,973,376 | A | * | 9/1934 | Freedman | A47G 25/28 223/1 |
| 2,044,425 | A | * | 6/1936 | Freysinger | F16B 45/02 59/95 |
| D108,579 | S | | 2/1938 | Perrone | |
| D297,483 | S | * | 9/1988 | Yann-San | D6/315 |
| D324,782 | S | | 3/1992 | Pedersen | |
| D342,612 | S | * | 12/1993 | McIntyre | D6/315 |
| 5,480,075 | A | | 1/1996 | Robinson | |
| 5,664,708 | A | * | 9/1997 | Sacks | A47G 25/743 223/85 |
| 6,425,167 | B1 | * | 7/2002 | Barbarite | A47G 25/00 24/298 |
| 6,758,378 | B2 | | 7/2004 | Carmichael | |
| 7,219,821 | B2 | | 5/2007 | Weal | |
| D552,852 | S | | 10/2007 | Schulz | |
| D679,103 | S | | 4/2013 | Hodgkinson | |

(Continued)

FOREIGN PATENT DOCUMENTS

GB 2480283 A * 11/2011

OTHER PUBLICATIONS

Hangpro Slide Hanger, available at http://www.thehangpro.com/slidehanger.aspx (last accessed Mar. 6, 2016).

(Continued)

*Primary Examiner* — Ismael Izaguirre
(74) *Attorney, Agent, or Firm* — Shane Cortesi

(57) ABSTRACT

The present invention relates to a garment hanger that is especially suited for life vests. The hanger may include a hanger body having a central portion with angled left and right legs that meet at an apex, generally flat left and right shoulders, and left and right ends that extend from the left and right shoulders, respectively, toward the apex. The hanger may also include a hook located adjacent to the apex of the hanger body. Hangers with an aperture at the top of the hanger and a cable to secure the hanger to an object are also described.

15 Claims, 8 Drawing Sheets

(56) References Cited

U.S. PATENT DOCUMENTS

| | | | | |
|---|---|---|---|---|
| D686,058 | S * | 7/2013 | Paik | D8/356 |
| 2013/0214015 | A1 | 8/2013 | Wood | |

OTHER PUBLICATIONS

Underwater Kinetics Super BC Hanger, available at http://www.uwkinetics.com/products/super-bc-hanger#.VtyFqZw4HIU (last accessed Mar. 6, 2016).

* cited by examiner

GARMENT HANGER

RELATED APPLICATIONS

This application claims priority under 35 USC 119 to Provisional Application Ser. No. 62/130,417, filed Mar. 9, 2015, the entire contents of which are hereby incorporated by reference.

BACKGROUND

Technical Field

The present invention relates to garment hangers, especially to hangers that are configured to hold a vest.

Background of the Invention

Life vests (also known as life jackets) and ski vest are prone to falling off traditional hangers. Thus, several manufacturers have developed hangers designed for life vests, wetsuits and other marine wear. For example, HangPro (San Diego, Calif.) sells the HANGPRO hanger on its website (www.thehangpro.com) and on www.amazon.com. The HANGPRO includes a long, flat main frame, an arm extending from the main frame, a hook attached to the arm, and an open end. It has been found that, while it is relatively easy to place a life vest on the HANG-PRO, the HANGPRO is very prone to tipping because the weight of the hanger is not evenly distributed due to the fact that there is much more weight on the side of the hanger with the arm than on the side with the open end. Underwater Kinetics (Poway, Calif.) sells a hanger under the name SUPER BC HANGER for snorkeling vests and other marine equipment that includes a main frame, a left end curving slightly from the main frame, a right end curving slightly from the main frame, a hook extending vertically upwards from the center of the main frame, and a bottom support extending from the bottom of the main frame. It has been found that a life vest is prone to sliding off the Underwater Kinetics hanger, which is due to, among other things, the fact that the main frame is relatively long and the left and right end curve upward a very short distance. In addition, the Underwater Kinetics hanger is very heavy.

Thus, there is need for new hangers for holding vests and other garments.

BRIEF SUMMARY

The present disclosure provides a hanger as described herein.

In some embodiments, the hanger includes: a hanger body, the hanger body comprising a left end comprising a left end leg, the left end leg comprising a base, a top end, and a length extending from the base to the top end; a right end comprising a right end leg, the right end leg comprising a base, a top end, and a length extending from the base to the top end; a hanger body length extending from the left end to the right end; a central portion comprising a left leg comprising a base and a top end, a right leg comprising a base and a top end, the left and right legs sloping towards each other from the base to the top ends and meeting at an apex located at the intersection of the left leg and the right leg; a generally flat right shoulder comprising a right end, a left end, and a right shoulder length extending from the right shoulder left end to the right shoulder right end; and a generally flat left shoulder comprising a left end, a right end, and a left shoulder length extending from the left shoulder left end to the left shoulder right end; wherein the left leg of the central portion extends from the right end of the left shoulder towards the apex at a first angle, the first angle greater than 90 degrees; wherein the right leg of the central portion extends from the left end of the right shoulder towards the apex at a second angle, the second angle greater than 90 degrees; wherein the left end leg extends from the left end of the left shoulder towards the apex at a third angle, the third angle less than 90 degrees; and wherein the right end leg extends from the right end of the right shoulder towards the apex at a fourth angle, the fourth angle less than 90 degrees.

Optionally, the left end leg and right end leg are generally straight. Optionally, the central portion legs are generally straight. Optionally, the left end leg is generally parallel to the central portion left leg and further wherein the right end leg is generally parallel to the central portion right leg. Optionally, the first and second angle are within about 5 degrees of each other. Optionally, the first and second angles are between about 130 and about 150 degrees. Optionally, the third and fourth angle are within about 5 degrees of each other. Optionally, the third and fourth angles are between about 30 and about 50 degrees. Optionally, the apex is approximately in the lengthwise center of the hanger body. Optionally, the top end of the left end leg and the top end of the right end leg are not connected to the apex. Optionally, the hanger further comprises a curved hook extending from the apex, the hook comprising a base and an apex, the curved hook configured to allow the hanger to hang from a cylindrical pole. Optionally, the hook comprises an aperture located approximately at the hook apex and approximately in the lengthwise center of the hanger body. Optionally, the hanger is provided in a kit comprising the hanger, a cable and a first clip, the cable comprising a first end configured to connect to the hook aperture and a second end configured to connect to the first clip. Optionally, the kit further comprises a second clip configured to join the hook aperture to the first end of the cable. Optionally, the hanger body further comprises a top, a bottom, and an apex aperture located approximately at the top of the hanger body, located approximately in the lengthwise center of the hanger body and located adjacent to the apex. Optionally, the hanger is provided in a kit comprising the hanger, a cable and a first clip, the cable comprising a first end configured to connect to the apex aperture and a second end configured to connect to the first clip. Optionally, the kit further comprises a second clip configured to join the apex aperture to the first end of the cable. Optionally, the hanger is configured to hold a vest. Optionally, the central portion is generally in the form of an isometric triangle without a base. Optionally, the length of the hanger body is between about 12 inches and about 20 inches. Optionally, the hanger is substantially symmetrical about the apex. Optionally, the length of the left and right shoulders approximately the same and is from about 2 inches to about 4 inches. Optionally, the top end of the left end leg is substantially co-planar with the top end of the right leg when the left and right shoulders are positioned parallel to the ground. Optionally, the left shoulder and right shoulder each comprise a base and a top end, and further wherein the distance between the top end of the left end leg and the base of the left shoulder is between about 4 to about 6 inches and further wherein the distance between the top end of the right end leg and the base of the right shoulder is between about 4 to about 6 inches. Optionally, the distance between the right end of the left shoulder and the left end of the right shoulder is from about 5 inches to about 8 inches.

Optionally, the hanger is used in a method that includes
a) providing the hanger;
b) placing a first portion of a garment on the generally flat left shoulder; and
c) placing a second portion of the garment on the generally flat right shoulder.

Optionally, the garment is a vest.

In still further embodiments, the hanger includes:
a) a hanger body, the hanger body comprising i) a left end comprising a left end leg, the left end leg comprising a base, a top end, and a length extending from the base to the top end; ii) a right end comprising a right end leg, the right end leg comprising a base, a top end, and a length extending from the base to the top end; iii) a hanger body length extending from the left end to the right end; iv) a central portion comprising a left leg comprising a base and a top end, a right leg comprising a base and a top end, the left and right legs sloping towards each other from the base to the top ends and meeting at an apex located at the intersection of the left leg and the right leg; v) a generally flat right shoulder comprising a right end, a left end, and a right shoulder length extending from the right shoulder left end to the right shoulder right end; and vi) a generally flat left shoulder comprising a left end, a right end, and a left shoulder length extending from the left shoulder left end to the left shoulder right end; and b) a curved hook extending from the apex, the hook comprising a base and an apex, the curved hook configured to allow the hanger to hang from a cylindrical pole; wherein the left leg of the central portion extends from the right end of the left shoulder towards the apex at a first angle, the first angle greater than 90 degrees; wherein the right leg of the central portion extends from the left end of the right shoulder towards the apex at a second angle, the second angle greater than 90 degrees; wherein the left end leg extends from the left end of the left shoulder towards the apex at a third angle, the third angle less than 90 degrees; and wherein the right end leg extends from the right end of the right shoulder towards the apex at a fourth angle, the fourth angle less than 90 degrees.

Optionally, the hook comprises an aperture located approximately at the hook apex and approximately in the lengthwise center of the hanger body. Optionally, the hanger is connected to a cable comprising a first end connected to the hook aperture and a second end connected to a first clip.

Optionally, the hanger is used in a method that includes;
a) providing the hanger;
b) providing a cable having a first end, a second end, and a cable length extending from the cable first end to the cable second end; and
c) connecting the cable first end to the hook aperture.

Optionally, the first end of the cable is connected to a second clip and step c) comprises attaching the second clip to the hook aperture. Optionally, the method further comprises connecting the cable second end to a first clip. Optionally, the method further comprises wrapping the cable around an object above the hanger, opening the first clip, and closing the first clip around a segment along the cable length (i.e between the first and second ends of the cable), thereby securing the hanger to the object.

In still further embodiments, the hanger includes: a hanger body, the hanger body comprising: a left end comprising a left end leg, the left end leg comprising a base, a top end, and a length extending from the base to the top end; a right end comprising a right end leg, the right end leg comprising a base, a top end, and a length extending from the base to the top end; a hanger body length extending from the left end to the right end; a central portion comprising a left leg comprising a base and a top end, a right leg comprising a base and a top end, the left and right legs sloping towards each other from the base to the top ends and meeting at an apex located at the intersection of the left leg and the right leg; a generally flat right shoulder comprising a right end, a left end, and a right shoulder length extending from the right shoulder left end to the right shoulder right end; and a generally flat left shoulder comprising a left end, a right end, and a left shoulder length extending from the left shoulder left end to the left shoulder right end; wherein the left leg of the central portion extends from the right end of the left shoulder towards the apex at a first angle, the first angle greater than 90 degrees; wherein the right leg of the central portion extends from the left end of the right shoulder towards the apex at a second angle, the second angle greater than 90 degrees; wherein the left end leg extends from the left end of the left shoulder towards the apex at a third angle, the third angle less than 90 degrees; wherein the right end leg extends from the right end of the right shoulder towards the apex at a fourth angle, the fourth angle less than 90 degrees; and wherein the hanger body further comprises a top, a bottom and an apex aperture located approximately at the top of the hanger body, located approximately in the lengthwise center of the hanger body and located adjacent to the apex.

Optionally, the hanger is connected to a cable comprising a first end connected to the apex aperture and a second end connected to a first clip.

In still further embodiments, the hanger is used a method that includes:
a) providing the hanger;
b) providing a cable having a first end, a second end and a cable length extending from the cable first end to the cable second end; and
c) connecting the cable first end to the apex aperture.

Optionally, the first end of the cable is connected to a second clip and step c) comprises attaching the second clip to the apex aperture.

Optionally, the method further comprises connecting the cable second end to a first clip.

Optionally, the method further comprises wrapping the cable around an object above the hanger, opening the first clip, and closing the first clip around a segment along the cable length, thereby securing the hanger to the object.

In still further embodiments, the present disclosure provides: a) a hanger body comprising: i) a bottom end; ii) a top end; iii) a left end; iv ) right end; v) a hanger body length extending from the left end to the right end; vi) a left shoulder configured to hold a portion of a garment; vii) a right shoulder configured to hold another portion of the garment; viii) an apex located between the left shoulder and the right shoulder and forming the top end of the hanger body; b) a curved hook extending from the apex, the hook comprising a base and an apex, the curved hook configured to allow the hanger to hang from a cylindrical pole; and c) an aperture located approximately at an apex of the hook and approximately in the lengthwise center of the hanger body.

Optionally, the hanger is connected to a cable comprising a first end connected to the hook aperture and a second end connected to a first clip.

Optionally, the hanger is used in a method that comprises;
a) providing the hanger;
b) providing a cable having a first end, a second end and a cable length extending from the cable first end to the cable second end; and
c) connecting the cable first end to the hook aperture.

Optionally, first end of the cable is connected to a second clip and step c) comprises attaching the second clip to the hook aperture. Optionally, the method further comprises connecting the cable second end to a first clip. Optionally, the method further comprises wrapping the cable around an object above the hanger, opening the first clip, and closing the first clip around a segment along the cable length, thereby securing the hanger to the object. Optionally, the method further comprises: placing a first portion of a garment on the left shoulder; and placing a second portion of the garment on the right shoulder.

In still further embodiments, the present disclosure provides: a hanger body comprising a bottom end; a top end; a left end; a right end; a hanger length extending from the left end to the right end; a left shoulder configured to hold a portion of a garment; a right shoulder configured to hold another portion of the garment; an apex located between the left shoulder and the right shoulder and forming the top end of the hanger body; and an apex aperture located approximately at the top of the hanger body, located approximately in the lengthwise center of the hanger body and located adjacent to the apex. Optionally, the hanger is connected to a cable comprising a first end connected to the apex aperture and a second end connected to a first clip. Optionally, the method comprises: a) providing the hanger; b) providing a cable having a first end, a second end and a cable length extending from the cable first end to the cable second end; and c) connecting the cable first end to the apex aperture.

Optionally, the first end of the cable is connected to a second clip and step c) comprises attaching the second clip to the apex aperture. Optionally, the method further comprises connecting the cable second end to a first clip. Optionally, the method further comprises wrapping the cable around an object above the hanger, opening the first clip, and closing the first clip around a segment along the cable length, thereby securing the hanger to the object. Optionally, the method further comprises: placing a first portion of a garment on the left shoulder; and placing a second portion of the garment on the right shoulder.

Without being bound to any particular theory, the cable allows attachment to a non-cylindrical object and also allow the hanger to be hung from an object that is significantly higher than the hanger body.

DETAILED DESCRIPTION

Figure 1:
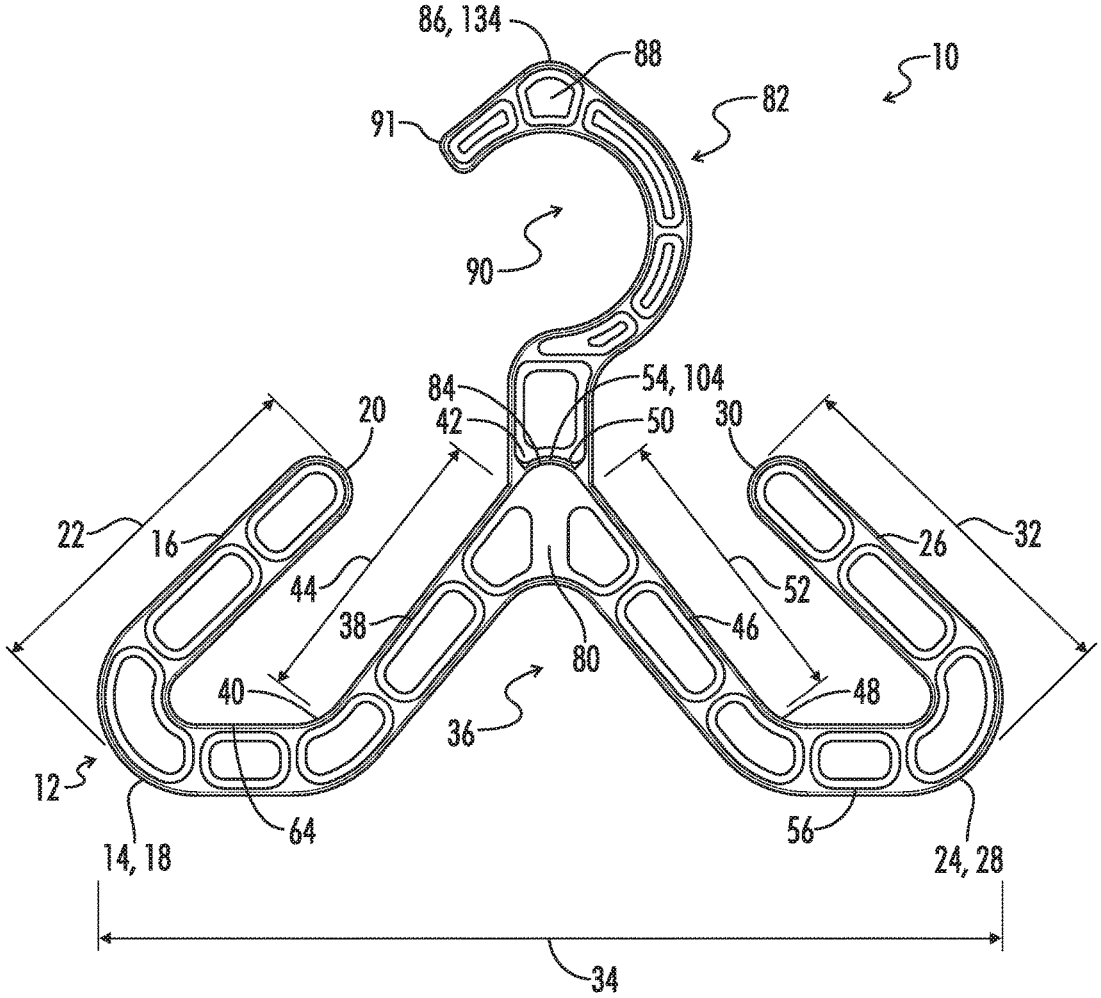
FIG. 1 illustrates a front, elevation view of a hanger with a hook of one embodiment of the present invention.
Figure 2:
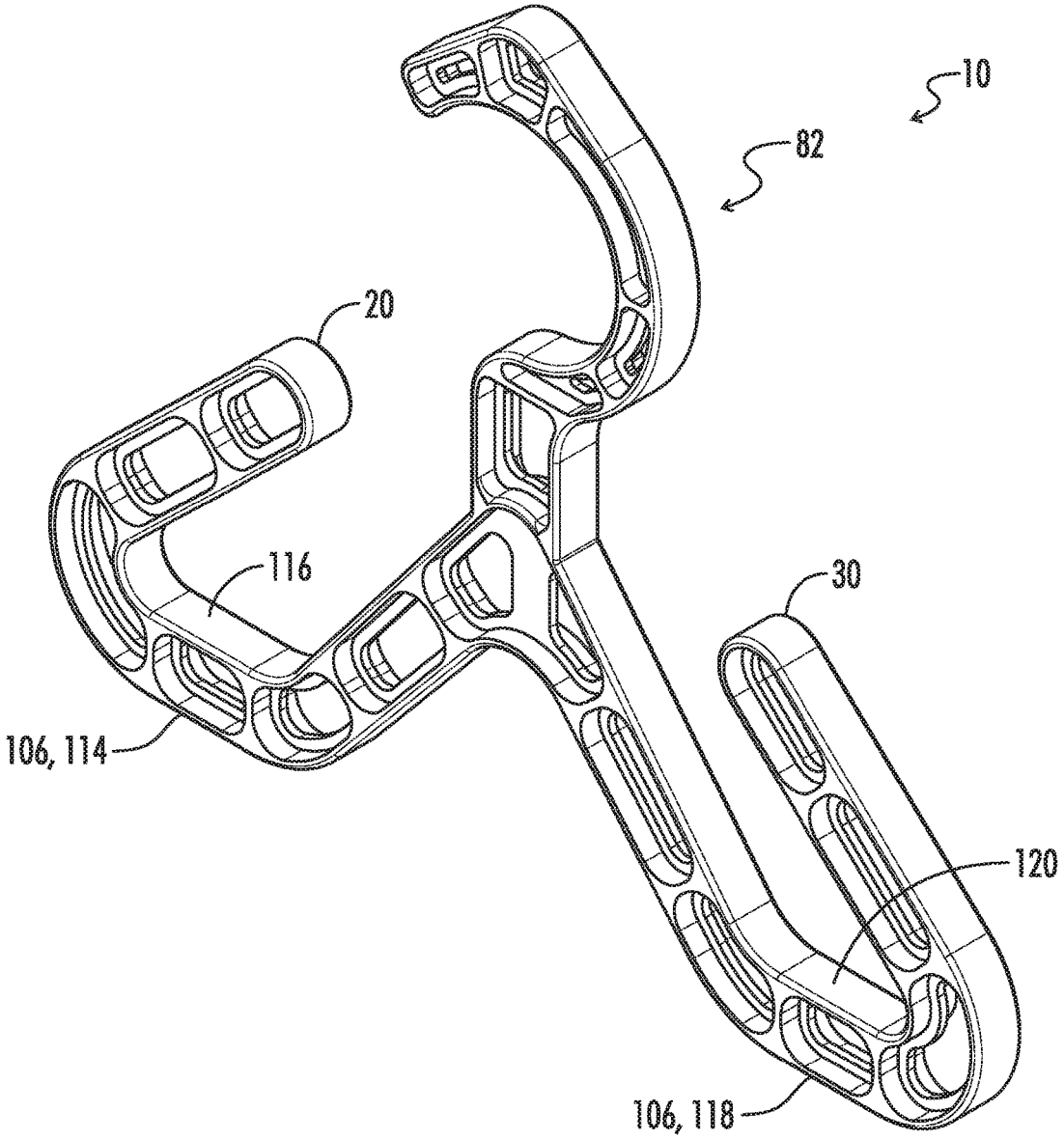
FIG. 2 illustrates an isometric view of the hanger of FIG. 1.

With reference to FIGS. 1-8 the present disclosure provides a hanger generally designated by the numeral 10. In the drawings, not all reference numbers are included in each drawing for the sake of clarity.

Referring to FIGS. 1-8, in some embodiments, the present disclosure provides a hanger 10 that includes a hanger body 12. In some embodiments, the hanger body 12 includes a left end 14 comprising a left end leg 16, the left end leg 16 comprising a base 18, a top end 20, and a length 22 extending from the base 18 to the top end 20; a right end 24 comprising a right end leg 26, the right end leg 26 comprising a base 28, a top end 30, and a length 32 extending from the base 28 to the top end 30; a hanger body length 34 extending from. the left end 14 to the right end 24; a central portion 36 comprising a left leg 38 comprising a base 40, a top end 42 and a length 44 extending from the base 40 to the top end 42, a right leg 46 comprising a base 48, a top end 50, and a length 52 extending from the base 48 to the top end 50, the central portion left 38 and right 46 legs sloping towards each other from the bases 40, 48 to the top ends 42, 50 and meeting at an apex 54 located at the intersection of the left leg 38 and the right leg 46; a right shoulder 56 comprising a right end 60, a left end 58, and a right shoulder length 62 extending from the right shoulder left end 58 to the right shoulder right end 60; and a left shoulder 64 comprising a left end 66, a right end 68, and a left shoulder length 70 extending from the left shoulder left end 66 to the left shoulder right end 68. Optionally, the right shoulder 56 and left shoulder 64 are generally flat.

Figure 7:
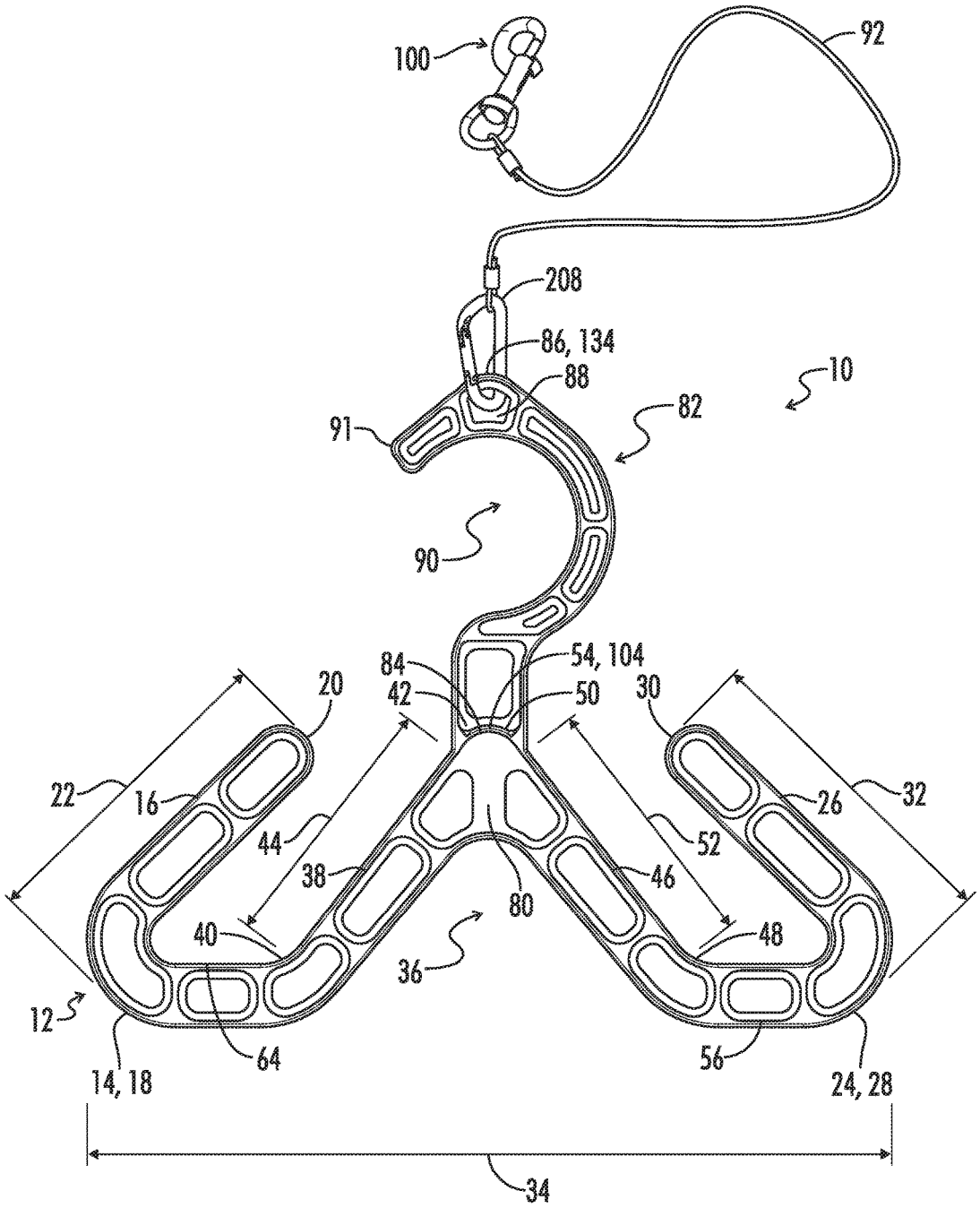
FIG. 7 illustrates a front, elevation view of a hanger with a hook of another embodiment of the present invention.
Figure 8:
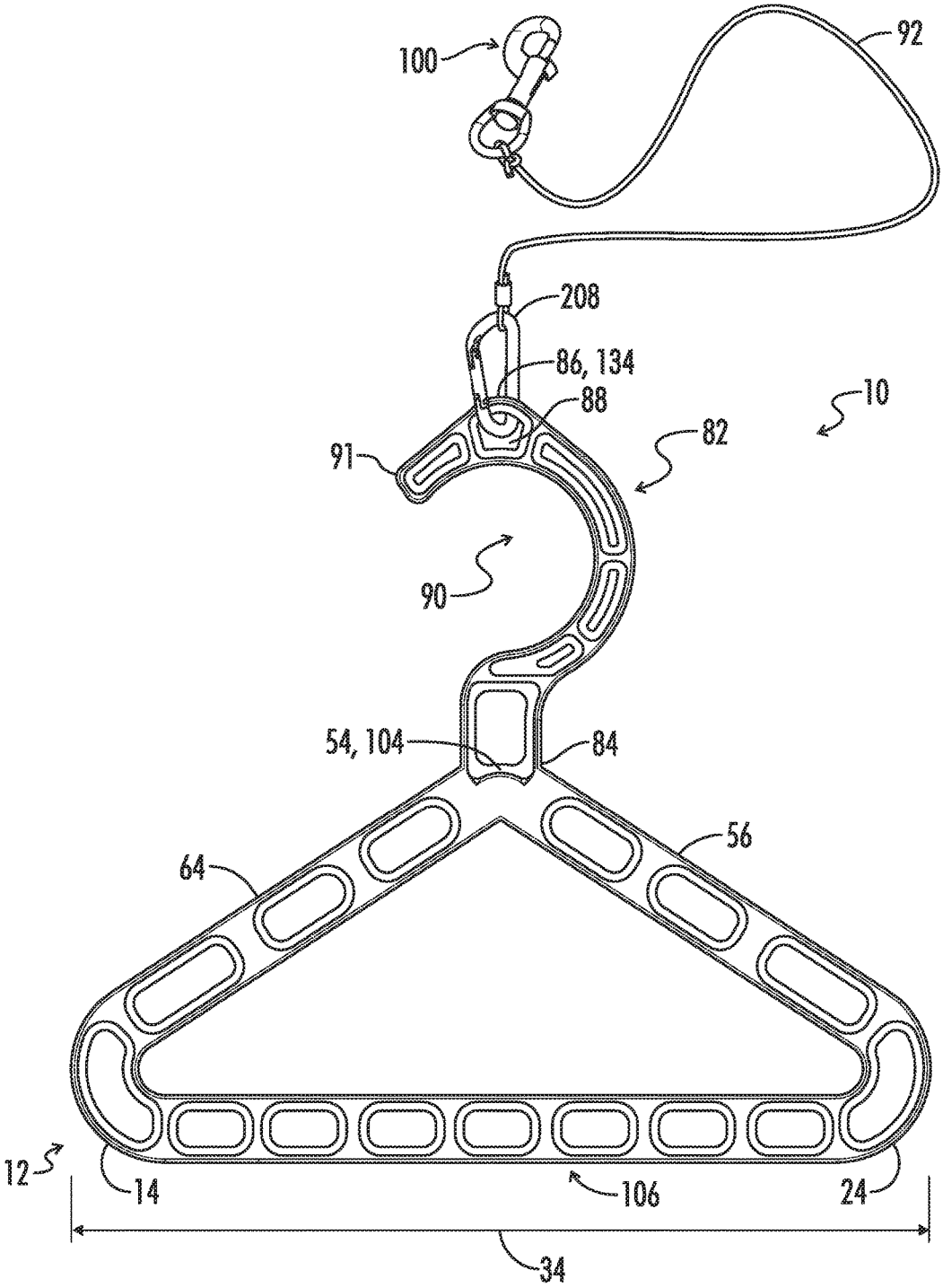
FIG. 8 illustrates a front, elevation view of a hanger with a hook of another embodiment of the present invention.

Optionally, the left leg 38 of the central portion 36 extends from the right end 68 of the left shoulder 64 towards the apex 54 at a first angle 72 (relative to the left shoulder 64), the first angle 72 greater than 90 degrees; the right leg 46 of the central portion 36 extends from the left end 58 of the right shoulder 56 towards the apex 54 at a second angle 74 (relative to the right shoulder 56), the second angle 74 greater than 90 degrees; the left end leg 16 extends from the left end 66 of the left shoulder 64 towards the apex 54 at a third angle 76 (relative to the left shoulder 64), the third angle 76 less than 90 degrees; and wherein the right end leg 26 extends from the right end 60 of the right shoulder 56 towards the apex 54 at a fourth angle 78 (relative to the right shoulder 56), the fourth angle 78 less than 90 degrees. Optionally, the left end leg 16 and right end leg 26 are generally straight. Optionally, the central portion legs 38 and 46 are generally straight. Optionally, the left end leg 16 is generally parallel to the central portion left leg 38 and further wherein the right end leg 26 is generally parallel to the central portion right leg 46. Optionally, the first and second angle 72 and 74 are within about 5 degrees of each other (i.e., the first and second angles 72 and 74 are approximately the same), which, along with symmetrical dimensions, provides a generally symmetrical hanger 10. Optionally, the first and second angles 72 and 74 are between about 130 and about 150 degrees. Optionally, the third and fourth angle 76 and 78 are within about 5 degrees of each other. Optionally, the third and fourth angles 76 and 78 are between about 30 and about 50 degrees. Optionally, the apex 54 is approximately in the lengthwise center 80 of the hanger body 12 (e.g., within about 0.5 inches of the lengthwise center 80 of the hanger body 12). Optionally, the top end 20 of left end leg 16 and the top end 30 of the right end leg 26 are not connected to the apex 54. Optionally, the distance 130 between the top end 20 of the left end leg 16 and the apex 54 and the distance 132 between the top end 30 of the right end leg 26 and the apex 54 are each between about 2 inches and about 5 inches (more preferably between about 3 inches and about 4 inches) which allows the vest or other garment 112 room to slip onto the left 64 and right shoulders 56. Optionally, the hanger 10 further comprises a curved hook 82 extending from the apex 54, the hook 82 comprising a base 104 and an apex 86, the curved hook 82 configured to allow the hanger 10 to hang from a horizontal cylindrical pole (like the poles generally found in closets). For example, the hook 82 may curve around an opening 90 and have a free end 91 like a traditional hanger, as shown in FIGS. 1-2 and 7-8. Optionally, the hook 82 comprises an aperture 88 located approximately at the hook apex 86 and approximately in the lengthwise center 80 of the hanger body 12. Optionally, the hanger 10 is provided in a kit with a cable 92 comprising a first end 94 configured to connect to the hook aperture 88 and a second end 96 connected to a first clip 100. The cable 92 may be comprised of any suitable material, for example, fabric (e.g., in the form of a rope) or plastic (e.g., weed trimmer line). The cable 92 may have a length of, for example, from about 15 inches to about 25 inches. Optionally, the cable 92 is connected to the hook aperture 88 via a second clip 208 that is a) connected to the cable first end 94 and b) removably attached to the hook aperture 88 (in other words the second clip 208 joins the cable 92 to the hook aperture 88). The clips can be spring-loaded, for example, or a carabiner clip. Alternatively, instead of a second clip 208, the cable 92 may be tied or otherwise attached to the perimeter of the hook aperture 88 or looped through the hook aperture 88. The cable 92 may be crimped as shown in FIGS. 6-8.

Figure 5:
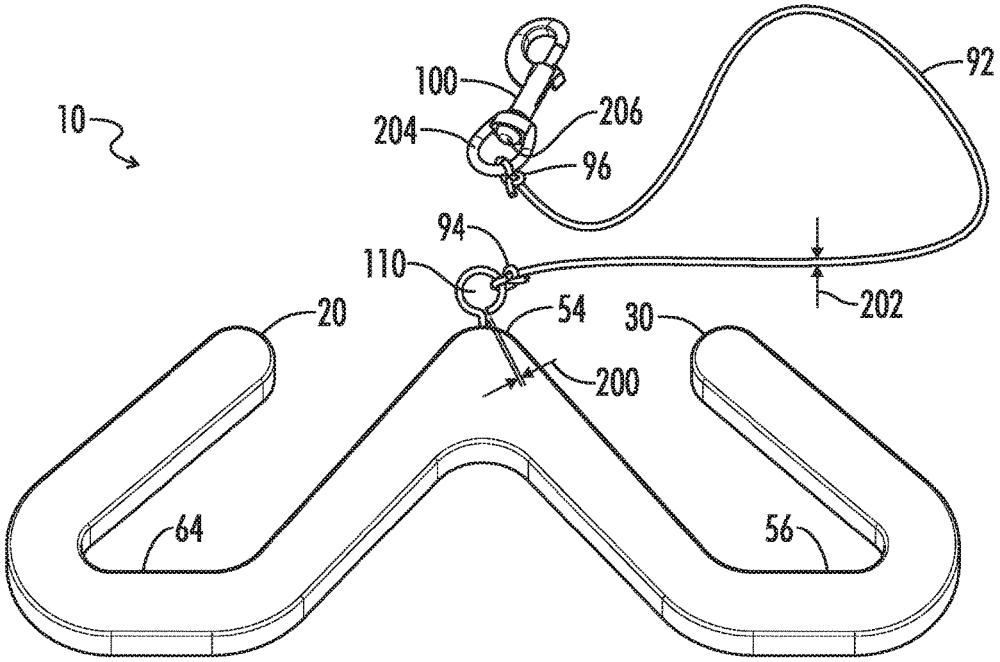
FIG. 5 illustrates an isometric view of a hanger of another embodiment of the present invention.
Figure 6:
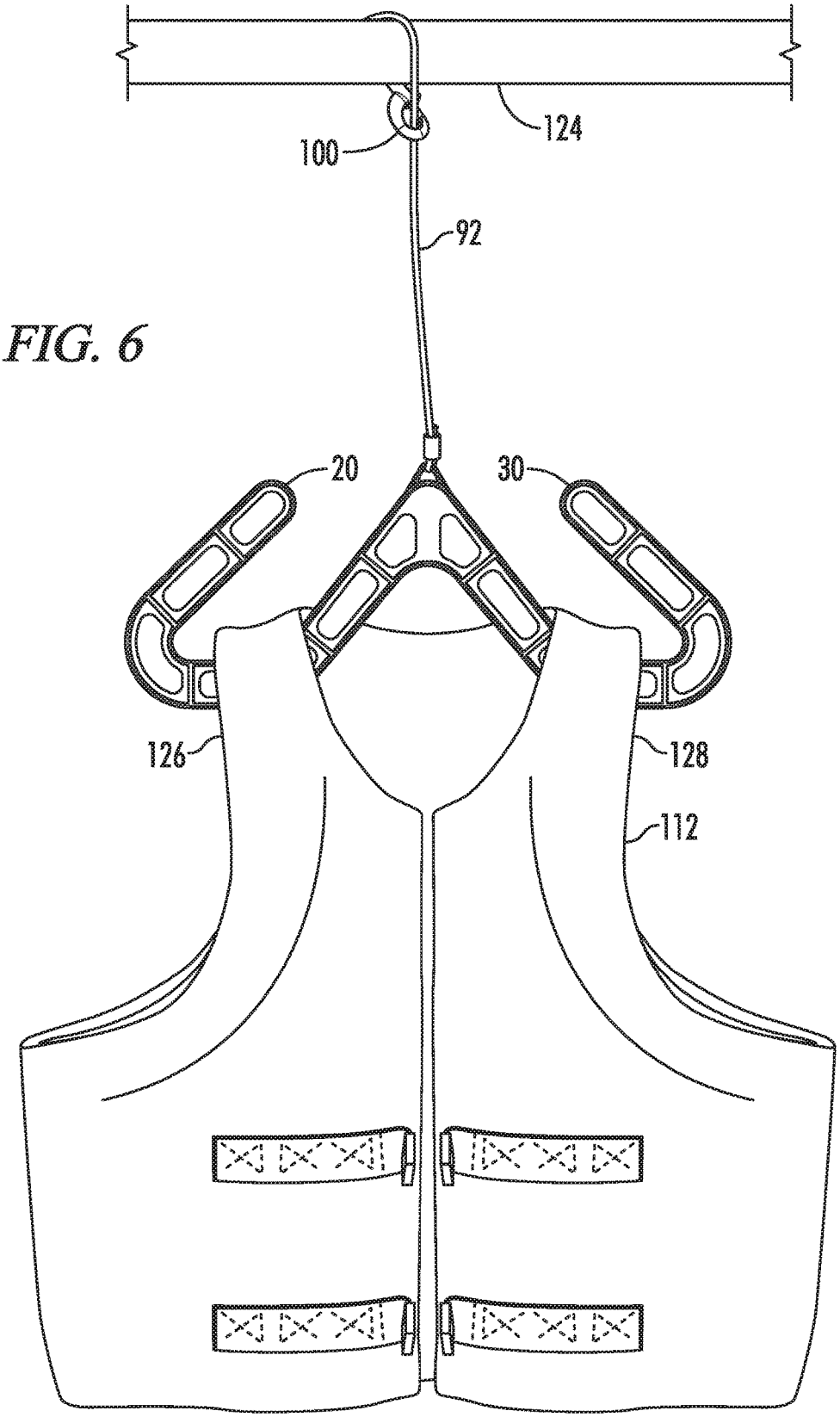
FIG. 6 illustrates a front elevation view of a hanger of another embodiment of the present invention connected to a cable being used to secure a life jacket, otherwise known as a life vest; the hanger of FIG. 6 includes an apex aperture at the apex of the hanger body, and the cable has a first end attached to the apex aperture and a second end attached to a clip.

Optionally, instead of a hook 82, the hanger 10 includes an apex aperture 110 located approximately at the top 104 of the hanger body 12, located approximately in the lengthwise center 80 of the hanger body 12 and located adjacent to the apex 54, as shown in FIGS. 3-6. The apex aperture 110 may be any suitable shape including generally cylindrical. The apex aperture 110 may be further connected to a cable 92 as with the prior embodiment for hanging the hanger 10 on an object 124, as shown in FIG. 6. It will be understood that when it is said that the cable 92 is connected to the apex aperture 110 or hook aperture 88, it will be understood that the cable 92 may be so connected using for example the second clip 208 or tying or attaching the cable 92 to the perimeter of the aperture 88 and 110 or looping the cable 92 through the aperture 88 or 110.

purpose of the apex aperture 110 and the hook aperture 88 is that the cable 92 can be used to secure the hanger 10 to a horizontal object 124 such as a tree limb or a rectangular post when a cylindrical post is not available, as shown in FIG. 6. In addition, in some embodiments, the hanger 10 lacks a hook as shown in FIGS. 3-6. The hook and apex apertures 88 and 110 should be surrounded by material (e.g., plastic) on all or substantially all sides of the apertures 88 and 110, as shown in FIGS. 1-8, if the apertures 88 and 110 are used with a second clip 208 in order to prevent the second clip 208 from slipping out of the apertures 88 and 110. In addition, if the cable 92 is tied or otherwise attached to the perimeter of the apertures 88 and 110 or is looped through the apertures 88 and 110, the apertures 88 and 110 should be surrounded by material on all or substantially all sides of the apertures 88 and 110. More particularly, the apex aperture 110 is surrounded by a fully closed perimeter, as shown in FIGS. 1-4 and 6-8 or a substantially closed perimeter, as shown in FIG. 5. If the perimeter surrounding the apex aperture is only substantially closed, preferably the width of the gap 200 crated by the perimeter is less than the width/diameter 202 of the cable 92. In addition, the apex and hook apertures 110 and 88 should be located at approximately the top (e.g., within about 0.5 inches, more preferably within about 0.25 inches) of the center of gravity of the hanger 10. Preferably, the apex and hook apertures 110 and 88 are located approximately at the top 134 of the hanger 10, as shown in FIGS. 1-8.

Figure 3:
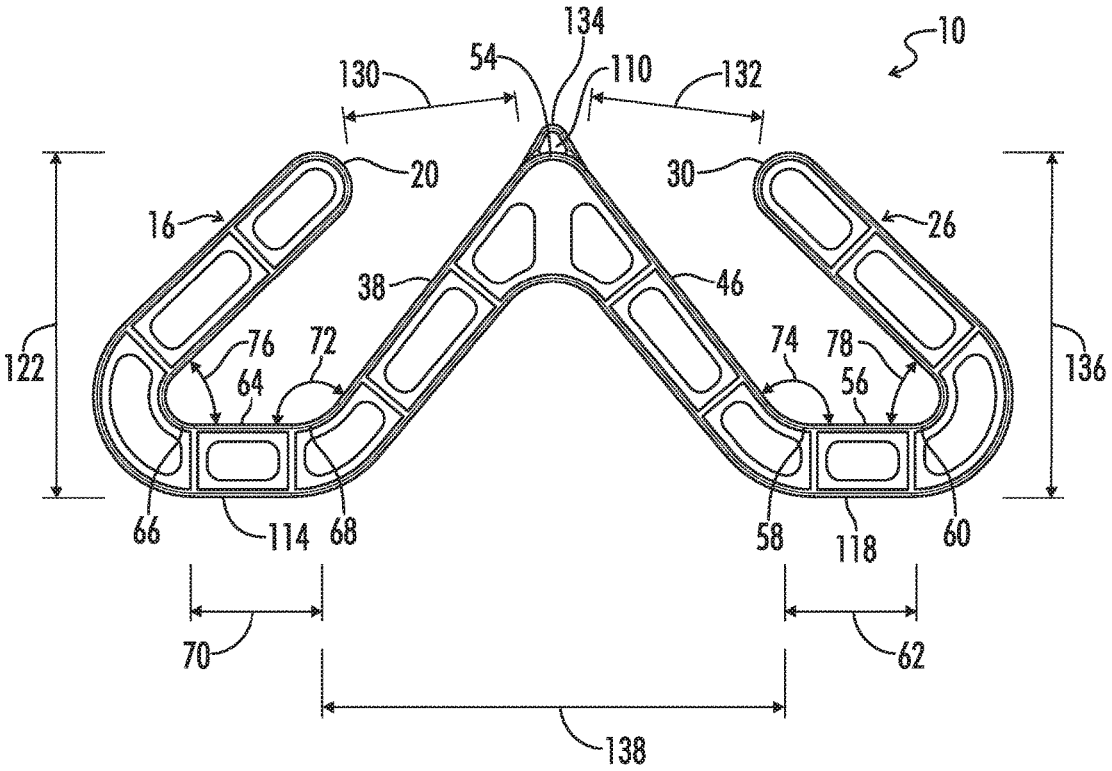
FIG. 3 illustrates a front, elevation view of a hanger of another embodiment of the present invention; the hanger of FIG. 3 does not have a hook.
Figure 4:
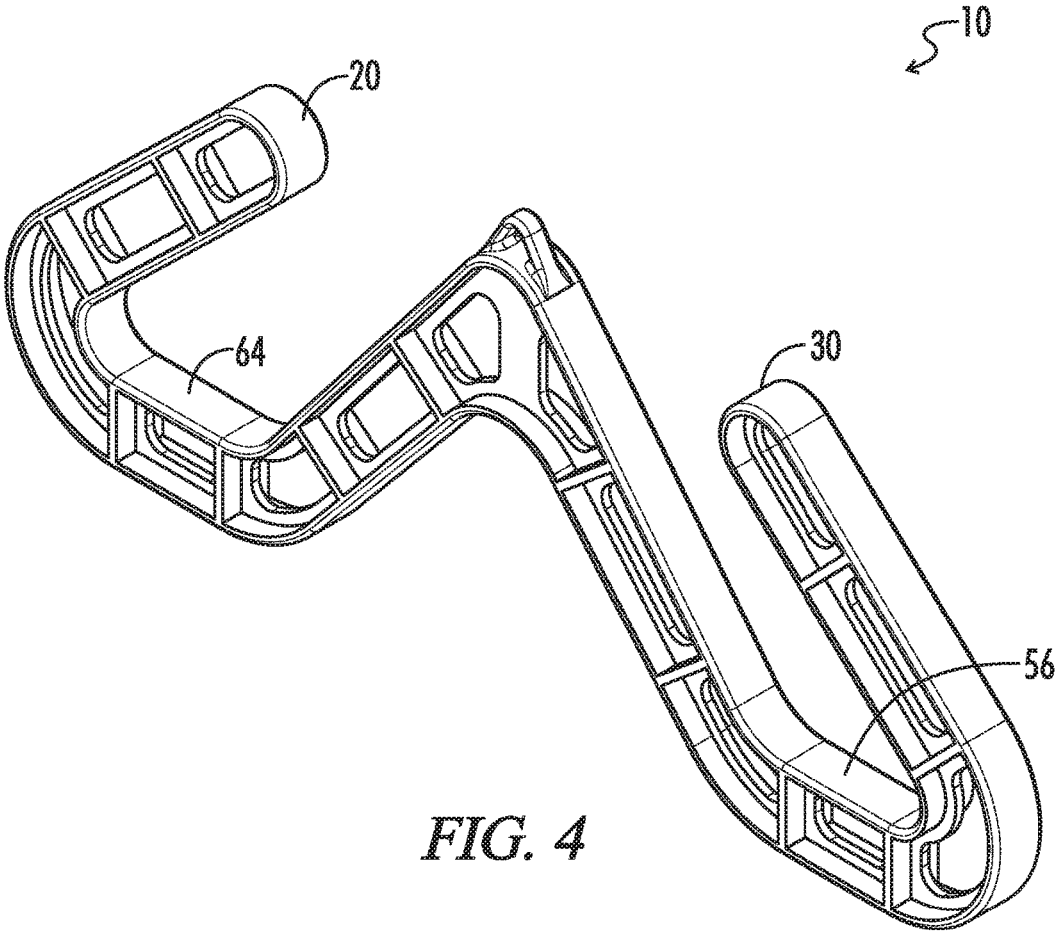
FIG. 4 illustrates an isometric view of the hanger of FIG. 3.

Optionally, the hanger 10 is configured to hold a vest 112, such as a life vest or a ski vest. Optionally, the central portion 36 is generally in the form of an isometric triangle without a base, as shown in FIGS. 1-7. Optionally, the entire length 34 of the hanger body 12 is between about 12 inches and about 20 inches. Optionally, the hanger 10 is substantially symmetrical about the apex 54. Optionally, the lengths 70 and 62 of each of the left 64 and right shoulders 56 are approximately the same and are from about 2 inches to about 4 inches. Optionally, the top end 20 of the left end leg 16 is substantially co-planar with the top end 30 of the right leg 26 when the left and right shoulders 64 and 56 are positioned parallel to the ground, as best seen in FIG. 3 (note top of lengths 122 and 136). Optionally, the left shoulder 64 and right shoulder 56 each comprise a base 114 and 118 and a top end 116 and 120, and further wherein the distance 122 between the top end 20 of the left end leg 16 and the base 114 of the left shoulder 64 is between about 4 to about 6 inches and further wherein the distance 136 between the top end 30 of the right end leg 26 and the base 118 of the right shoulder 56 is between about 4 to about 6 inches. Optionally, the distance 138 between the right end 68 of the left shoulder 64 and the left end 58 of the right shoulder 56 is from about 5 inches to about 8 inches. Optionally, the hanger 10 is comprised of a single, continuous piece of material prepared by for example plastic injection molding. The hanger 10 may also be comprised of wood.

The hanger 10 may be used in any suitable method, including but not limited to a method that includes a) providing the hanger 10; b) placing a first portion 126 (e.g., a left side) of a garment 112 on the generally flat left shoulder 64; and c) placing a second portion 128 (e.g., the right side) of the garment 112 on the generally flat ght shoulder 56. See FIG. 6. Optionally, the garment 112 is a vest. Optionally, the method further comprises; providing a cable 92 having a first end 94, a second end 96 connected to a first clip 100 and a cable length extending from the cable first end 94 to the cable second end 96; and connecting the cable first end 94 to the hook aperture 88 (using, for example, a second clip 208 attached to the cable first end 94 or tying or otherwise attaching the cable 92 to the perimeter of the aperture 88 or looping the cable 92 through the aperture 88). Optionally, the method further comprises wrapping the cable 92 around an object 124 above the hanger 10, opening the first clip 100, and closing the first clip 100 around a segment along the cable length, thereby securing the hanger 10 to the object 124. See FIG. 6. Optionally, the hanger 10 uses an apex aperture 110 instead of a hook 82 and hook aperture 88 and the method comprises attaching the cable first end 94 to the apex aperture 110 using the second clip 208 or tying or otherwise attaching the cable 92 to the perimeter of the aperture 110 or looping the cable 92 through the aperture 110). In some embodiments, the cable 92 may be attached to the first clip 100 via a clip base 204 that is rotatably attached to the first clip 100 using a pin 206 so that the first clip 100 may rotate in the wind when the hanger 10 is hung as shown in FIG. 6. Thus, the clip base 204 has a first end rotatably attached to the first cable clip 100 and a second end attached to the second end 96 of the cable 92.

In still further embodiments, the apex aperture 110 or hook aperture 88 and cable 92 and clip 100 system may be used in connection with a traditional hanger, as shown in FIG. 8. More particularly, in some embodiments, the hanger 10 includes: a) a hanger body 12 comprising i) a bottom end 106; ii) a top end 104; iii) a left end; 14 iv) a right end 24; v) a hanger length 34 extending from the left end 14 to the right end 24; vi) a left shoulder 64 configured to hold a portion of a garment 112; vii) a right shoulder 56 configured to hold another portion of the garment 112; viii) an apex 54 located approximately midway between the left shoulder 64 and the right shoulder 56 and forming the top end 104 of the hanger body 12; and b) a curved hook 82 extending from the apex 54, the curved hook 82 comprising a base 84 and an apex 86, the curved hook 82 configured to allow the hanger 10 to hang from a cylindrical pole 124; and c) a hook aperture 88 located approximately at the apex 86 of the hook 82 and approximately in the lengthwise center of the hanger body 12. Optionally, a cable 92 is attached to the hook aperture 88 as described above. The hook 82 and hook aperture 88 may be as previously described above. Optionally, the hanger 10 is used in a method that includes providing the hanger 10; placing a first portion of a garment 112 on the left shoulder 64; and placing a second portion of the garment 112 on the right shoulder 56. In other embodiments, the hanger 10 includes an apex aperture 110 located approximately at the top 104 of the hanger body 12, located approximately in the lengthwise center of the hanger body 12 and located adjacent to the apex 54, instead of a hook 82.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A hanger comprising:

a hanger body comprising:

a hanger body top;

a hanger body bottom located below the hanger body top;

a hanger body height extending from the hanger body top to the hanger body bottom;

a hanger body left end;

a hanger body right end;

a hanger body length extending from the hanger body left end to the hanger body right end and generally perpendicular to the hanger body height, the hanger body length having a center;

an isometric triangle located in the center of the hanger body length, the isometric triangle comprising a left leg comprising a left leg top end and a left leg bottom end, the isometric triangle further comprising a right leg comprising a right leg top end and a right leg bottom end, the right leg top end and the left leg top end meeting at an apex, the apex located at the hanger body top, the left leg bottom end and the right leg bottom end located at the hanger body bottom;

a generally straight left shoulder located at the hanger body bottom and extending generally parallel to the hanger body length from the left leg bottom end to the hanger body left end, the generally straight left shoulder having a left end located at the hanger body left end;

a left end leg extending inwardly from the generally straight left shoulder end toward the center of the hanger body length at an angle of less than 90 degrees;

a generally straight right shoulder located at the hanger body bottom and extending generally parallel to the hanger body length from the right leg bottom end to the hanger body right end, the generally straight right shoulder having a right end located at the hanger body right end; and a right end leg extending inwardly from the generally straight right shoulder end toward the center of the hanger body length at an angle of less than 90 degrees, wherein the hanger further comprises a cable connected to the apex.

2. The hanger of claim 1 wherein the left end leg is generally straight and comprises a free top end and wherein the right end leg is generally straight and comprises a free top end.

3. The hanger of claim 2 further wherein the free top ends are located below the apex.

4. The hanger of claim 1 wherein the cable further comprises a first end connected to the apex and a second end connected to a clip.

5. The hanger of claim 1, wherein, when the left shoulder and right shoulder are positioned parallel to the ground and the apex is positioned above the hanger body bottom, the left end leg is generally parallel to the left leg and the right end leg is generally parallel to the right leg.

6. The hanger of claim 1 wherein the isometric triangle comprises an open base opposite the apex.

7. The hanger of claim 1 wherein the left end leg, the left leg, the right end leg, and the right leg are generally straight.

8. A method of using a hanger to hang a life vest, the method comprising the steps of:

a) providing the hanger of claim 1;

b) providing a life vest having a left shoulder strap and a right shoulder strap;

c) placing the left shoulder strap of the life vest on the left shoulder of the hanger and placing the right shoulder strap of the life vest on the right shoulder of the hanger to secure the life vest to the hanger; and d) connecting the cable to a support so that the hanger and life vest hang downwardly from the support.

9. A hanger comprising:

a hanger body comprising:

a hanger body top;

a hanger body bottom located below the hanger body top;

a hanger body height extending from the hanger body top to the hanger body bottom;

a hanger body left end;

a hanger body right end;

a hanger body length extending from the hanger body left end to the hanger body right end and generally perpendicular to the hanger body height, the hanger body length having a center;

an isometric triangle located in the center of the hanger body length, the isometric triangle comprising a left leg comprising a left leg top end and a left leg bottom end, the isometric triangle further comprising a right leg comprising a right leg top end and a right leg bottom end, the right leg top end and the left leg top end meeting at an apex, the apex located at the hanger body top, the left leg bottom end and the right leg bottom end located at the hanger body bottom;

a generally straight left shoulder located at the hanger body bottom and extending generally parallel to the hanger body length from the left leg bottom end to the hanger body left end, the generally straight left shoulder having a left end located at the hanger body left end;

a left end leg extending inwardly from the generally straight left shoulder end toward the center of the hanger body length at an angle of less than 90 degrees;

a generally straight right shoulder located at the hanger body bottom and extending generally parallel to the hanger body length from the right leg bottom end to the hanger body right end, the generally straight right shoulder having a right end located at the hanger body right end; and a right end leg extending inwardly from the generally straight right shoulder end toward the center of the hanger body length at an angle of less than 90 degrees, wherein the hanger further comprises a hook extending from the apex.

10. The hanger of claim 9 wherein the left end leg is generally straight and comprises a free top end and wherein the right end leg is generally straight and comprises a free top end.

11. The hanger of claim 10 further wherein the free top ends are located below the apex.

12. The hanger of claim 9, wherein, when the left shoulder and right shoulder are positioned parallel to the ground and the apex is positioned above the hanger body bottom, the left end leg is generally parallel to the left leg and the right end leg is generally parallel to the right leg.

13. The hanger of claim 9 wherein the isometric triangle comprises an open base opposite the apex.

14. The hanger of claim 9 wherein the left end leg, the left leg, the right end leg, and the right leg are generally straight.

15. A method of using a hanger to hang a life vest, the method comprising the steps of:

a) providing the hanger of claim 9;

b) providing a life vest having a left shoulder strap and a right shoulder strap;

c) placing the left shoulder strap of the life vest on the left shoulder of the hanger and placing the right shoulder strap of the life vest on the right shoulder of the hanger to secure the life vest to the hanger; and d) placing the hook onto a support so that the hanger and life vest hang downwardly from the support.

* * * * *